United States Patent [19]

Ohno

[11] 4,067,599

[45] Jan. 10, 1978

[54] TRIM ALIGNMENT FOR MORTISE LOCKS

[75] Inventor: Richard J. Ohno, Branford, Conn.

[73] Assignee: Walter Kidde & Company, Inc., Clifton, N.J.

[21] Appl. No.: 675,558

[22] Filed: Apr. 9, 1976

[51] Int. Cl.[2] ..... E05C 1/16

[52] U.S. Cl. ..... 292/356; 292/357

[58] Field of Search ..... 292/356, 347, 169, 357, 292/358, 359

[56] References Cited

U.S. PATENT DOCUMENTS

| | | | |
|---|---|---|---|
| 109,409 | 11/1870 | Henderson | 292/357 |
| 297,402 | 4/1884 | Howland | 292/357 X |
| 2,846,255 | 8/1958 | Wardwell, Jr. | 292/356 X |
| 2,924,480 | 2/1960 | Holland | 292/356 X |

*Primary Examiner*—Richard E. Moore

*Attorney, Agent, or Firm*—DeLio and Montgomery

[57] ABSTRACT

Trim alignment means for a mortise lock which includes a bushing screwed into the lock case, a trim aligner screwed onto the bushing, means for anchoring the trim aligner on the door face, a rose and rose bushing mounted on the trim aligner and a knob bushing fixed in the rose bushing, whereby the knob, spindle and trim are held in correct alignment with the hub of the lockset.

9 Claims, 3 Drawing Figures

Fig. 1
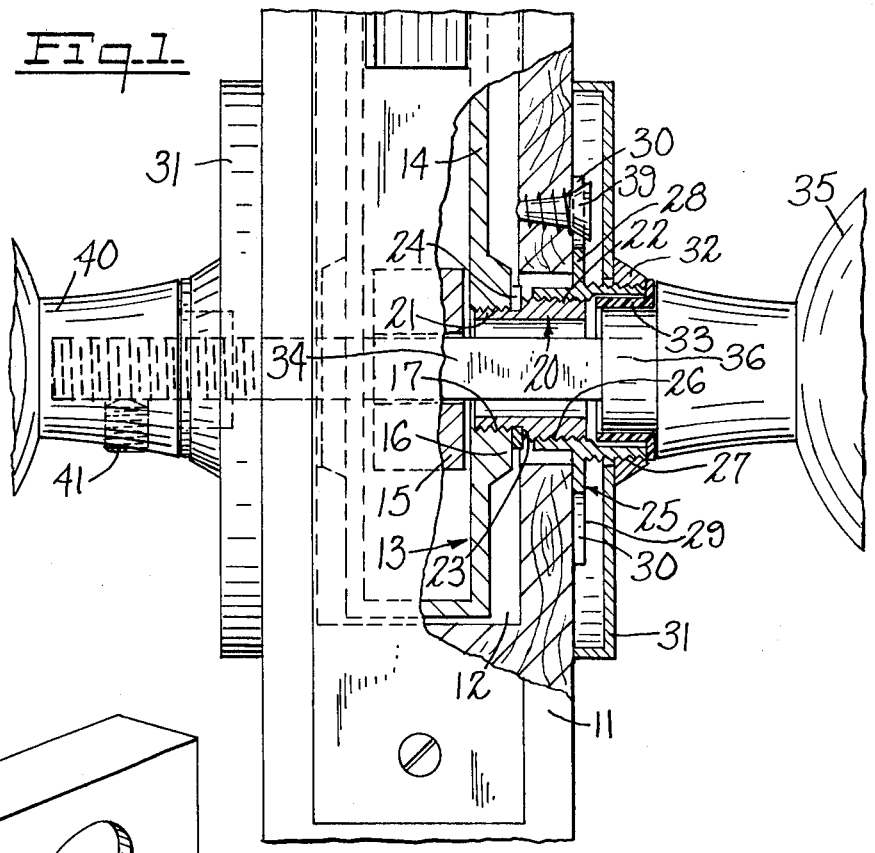
Fig. 3
Fig. 2
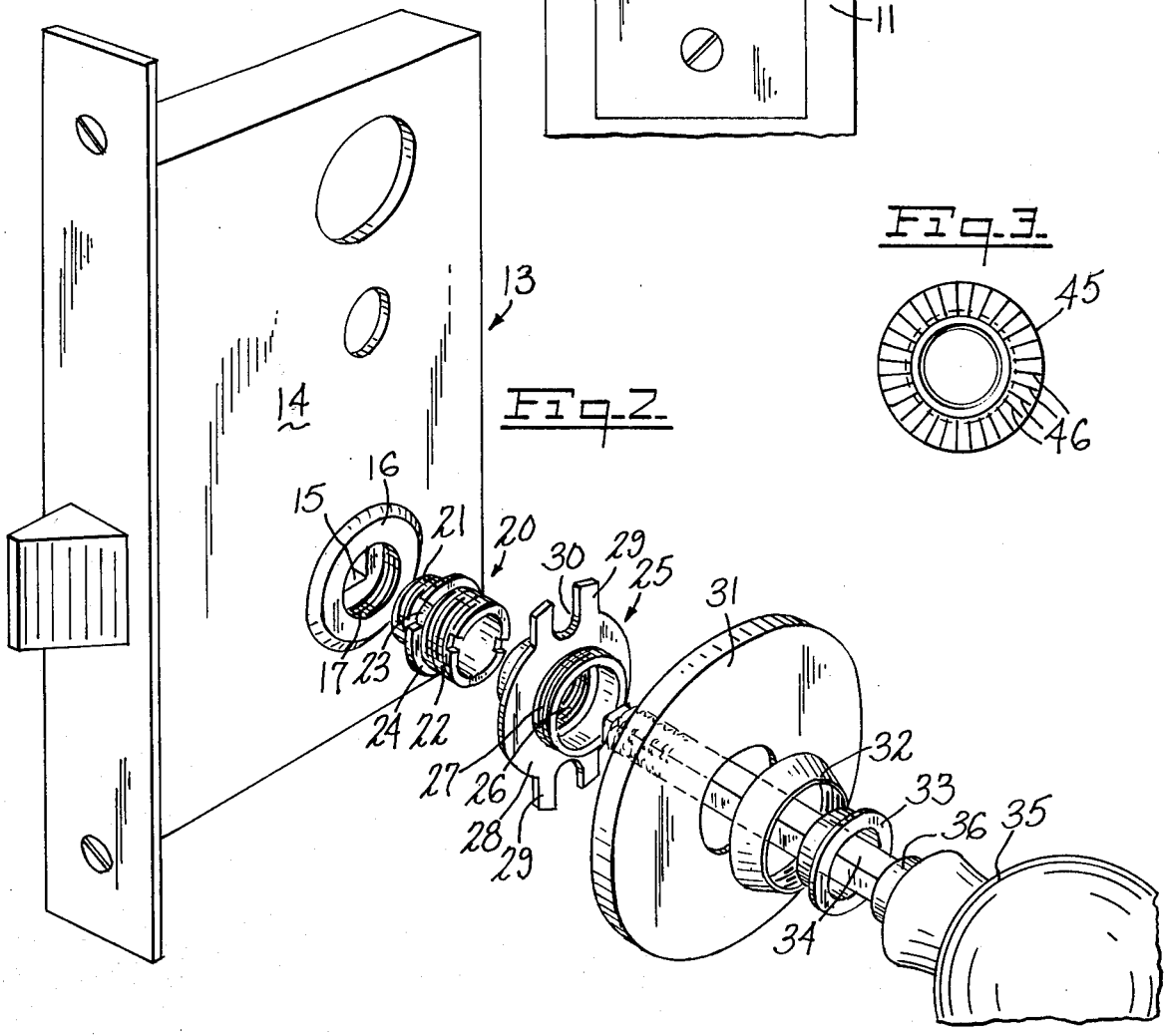

TRIM ALIGNMENT FOR MORTISE LOCKS

This invention relates to trim alignment means for a mortise lock wherein the spindle is located in a bushing which is rigidly connected to the lock case in a position to hold the spindle in correct alignment with the hub of the lockset.

In door locks having a mortise type lockset it has been customary to journal the spindle, at its point of connection with a knob or handle, in a bushing which is mounted on a back plate (beneath the rose) which, in turn, is mounted on the door face by means of two or more screws. The axis of the bushing is aligned as accurately as possible with the axis of lockset hub and this alignment, whether correct or not, is maintained by the engagement of the screws in the door face. There is a substantial amount of play between the spindle and the hub, so that exact positioning of the back plate, with its axis corresponding with the hub axis, is difficult to achieve. When the back plate screws become loosened the entire trim assembly is free to wobble with considerable amplitude, causing the edge of the rose to scar the door surface.

It is accordingly an object of the present invention to provide trim alignment means wherein the bushing supporting the spindle at its point of connection to a knob or handle is connected rigidly to the case of the lockset.

It is a further object of the invention to provide a double threaded bushing, one end of which is screwed into the case, the other (outer) end being adapted to receive a trim aligner, on which the rose, rose bushing and spindle bushing may be mounted.

It is another object of the invention to provide means for stabilizing the trim aligner against loosening.

It is a still further object of the invention to provide certain improvements in the form, construction and arrangement of the several parts whereby the above named and other objects may effectively be attained.

The invention accordingly comprises an article of manufacture possessing the features, properties, and the relation of elements which will be exemplified in the article hereinafter described, and the scope of the invention will be indicated in the claims.

A practical embodiment of the invention is shown in the accompanying drawing wherein:

FIG. 1 represents an elevation of the edge of a door having fitted therein a mortise type lockset with inner and outer knobs, parts being broken away and parts being in section;

FIG. 2 represents an exploded perspective view of the elements comprising the invention; and FIG. 3 represents a detail elevation showing the inner surface of an alternative form of trim aligner.

Referring to the drawing, a door 11 is mortised as indicated at 12 to receive the mortise lockset 13. Each side wall 14 of the lockset case has openings in the customary locations and the walls of the case adjacent the latch hub 15 are thickened, as shown at 16, the holes 17 in the thickened portions being threaded.

The case aligner 20 is a double threaded bushing, its inner end portion 21 being threaded to engage in the hole 17 and its outer portion 22, of a slightly larger diameter, being threaded to receive the trim aligner. Between the portions 21 and 22 the case aligner is provided with an annular groove 23 in which the C-ring 24 is snapped. The case aligner could, alternatively, be formed with an integral flange in the position of the C-ring.

The trim aligner 25 is also in the form of a bushing, internally threaded at 26 to be screwed onto the portion 22 of the case aligner, externally threaded at 27 to receive the rose bushing and provided with a medially located annular collar or flange 28, the latter having oppositely disposed projections 29 defining openings in the form of radially open slots 30, for a purpose to be described below.

The trim assembly is completed by the rose 31, the rose bushing 32, the nylon spindle bushing 33, and spindle 34 and the knob 35, the knob being fixed on the spindle in the usual manner and being provided with a shoulder 36 adapted to fit freely within the nylon spindle bushing 33. The term "knob" is intended to include a handle or the like.

To assemble the parts described above, assuming the lockset 13 to be installed in the door as shown in FIG. 1, the case aligner 20 is screwed into the hole 17 to engage the C-ring 24 tightly against the surface of the case. The trim aligner 25 is screwed on to the portion 22 of the case aligner to a point where the collar or flange 28 bears firmly against the surface of the door, as shown in FIG. 1 and a trim aligner screw 39 is placed in one of the slots 30 and screwed into the door, to prevent the trim aligner from unscrewing. The advancement of the trim aligner on the case aligner is determined by the thickness of the door material adjacent to the mortise.

The spindle 34 and knob 35 are assembled in the usual manner with the nylon bushing 33, rose bushing 32 and rose 31 loosely threaded on the spindle, which is then passed through the aligners 25 and 20, and into and through the hub 15.

The rose 31 is then fitted onto the trim aligner, the rose bushing 32 is screwed thereon, finger tight, to hold the rose against the door surface, and the nylon bushing 33 is force fitted into the trim aligner. With the parts 31–34 thus assembled, the spindle is advanced through the hub 15 and out the opposite side of the door, through a corresponding assembly of elements, to be secured to a second knob 40 by means of the set screw 41, in a customary manner.

In the alternative form of trim aligner shown in FIG. 3, the projections 29 and slots 30 are eliminated, the collar or flange 45 being annular and provided on its inner face (toward the door surface) with surface irregularities 46 such as serrations, ridges or scoring, adapted to bite into the door surface when the aligner is screwed home, to an extent sufficient to prevent unscrewing when the assembly has been completed.

From the foregoing it will be apparent that the entire trim assembly is supported and/or positioned in a rigid and positive manner in positions which are fixed relative to the case of the lockset and to the latch hub journaled therein. The nylon bushing 33 is both a thrust and a circular bearing for the shoulder 36 on the knob, the knob and spindle being retained in accurate axial alignment with the axis of the hub, and the corresponding structure on the other side of the door results in the spindle being supported in fixed bearings spaced as far apart as possible, with the most advantageous lever arm. Any looseness or play between the knob and the spindle can have no effect on the alignment of the spindle with the hub.

While the arrangement of threaded portions as shown is considered to be preferable, it would be possible to thread the portion 22 internally and to substitute an external thread on the trim aligner in place of internal thread 26.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing shall be interpreted as illustrative and not in a limiting sense.

What I claim is:

1. Lock trim alignment means for use with a mortise lock having a case and a latch hub and being installed in a door, comprising, a threaded opening in the lock case coaxial with the latch hub, a first bushing screwed into said threaded opening, a second bushing screwed onto the first bushing, a flange associated with the second bushing and projecting laterally in a position to engage a door surface adjacent said bushings, and a knob and spindle assembly journaled in said second bushing with the spindle aligned with the common axis of said bushings and hub.

2. Lock trim alignment means according to claim 1 wherein the first bushing is provided with a stop to limit its movement into said opening.

3. Lock trim alignment means according to claim 2 wherein the first bushing is formed medially with an annular groove and the stop is a C-ring fitted in said groove.

4. Lock trim alignment means according to claim 1 wherein the flange is integral with the second bushing.

5. Lock trim alignment means according to claim 4 wherein the flange is provided with openings to receive rotation preventing means.

6. Lock trim alignment means according to claim 4 wherein the flange is provided with surface irregularities adapted to engage the door surface.

7. Lock trim alignment means for use with a mortise lock having a case and a latch hub therein and being installed in a door, the lock case being provided with a threaded opening coaxial with the latch hub, the alignment means comprising a first bushing having first and second threaded portions and a stop and the first threaded portion being screwed in said threaded opening with said stop against the case, and a second bushing having two threaded portions with a flange therebetween, one threaded portion being adapted to be engaged with the second threaded portion of the first bushing, the flange being adapted to be engaged with a door surface adjacent said bushings when the second bushing is screwed onto the first bushing and the other threaded portion projecting axially outwardly beyond the plane of said flange and adapted to receive additional trim elements.

8. Lock trim alignment means according to claim 7 wherein the additional trim elements comprise a rose and a bushing screwed onto said other threaded portion to hold the rose firmly against the adjacent door surface.

9. Lock trim alignment means according to claim 7 wherein said axially projecting portion is provided with an antifriction bearing element adapted for a free fit with a complementary surface of a knob.

* * * * *